United States Patent [19]

Eastman

[11] 4,194,559

[45] Mar. 25, 1980

[54] FREEZE ACCOMMODATING HEAT PIPE

[75] Inventor: George Y. Eastman, Lancaster, Pa.

[73] Assignee: Thermacore, Inc., Leola, Pa.

[21] Appl. No.: 956,680

[22] Filed: Nov. 1, 1978

[51] Int. Cl.[2] ..... F28D 15/00

[52] U.S. Cl. ..... 165/105; 165/134 R

[58] Field of Search ..... 165/105, 134

[56] References Cited

U.S. PATENT DOCUMENTS

| | | | |
|---|---|---|---|
| 3,604,504 | 9/1971 | Kessler, Jr. et al. | 165/105 |
| 3,754,594 | 8/1973 | Ferrell | 165/105 X |

*Primary Examiner*—Albert W. Davis

*Attorney, Agent, or Firm*—Martin Fruitman

[57] ABSTRACT

A heat pipe wick which can survive freezing of the heat transfer fluid within the heat pipe and return to full operation automatically. A flexible high lift wick is used with a limited liquid inventory to prevent damage from freezing. The limited amount of liquid is completely retained in the wick at all times by capillary forces preventing puddling at the lowest point in the heat pipe, thus avoiding damage to the casing by expansion.

4 Claims, 1 Drawing Figure

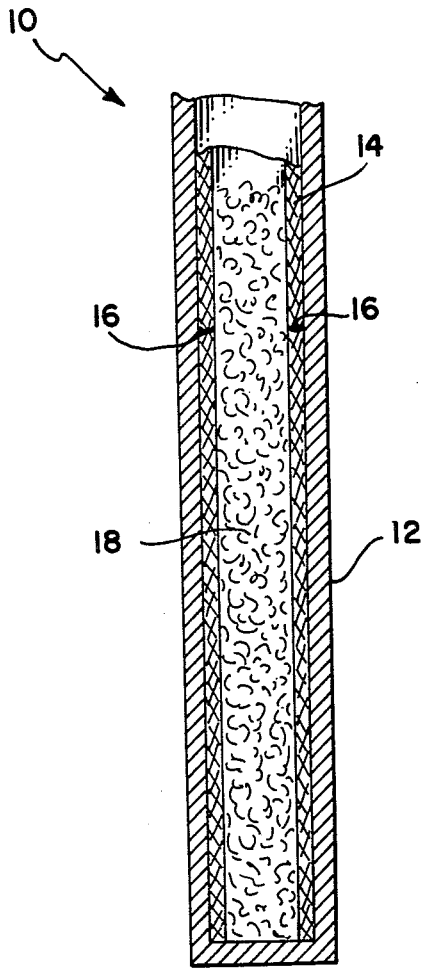
10
14
16
16
18
12

FREEZE ACCOMMODATING HEAT PIPE

BACKGROUND OF THE INVENTION

The field of this invention, generally is heat exchangers and, more particularly, it deals with the type of condensing and evaporating system referred to in the art as a heat pipe.

While water is a highly desirable heat pipe fluid for operating temperatures between 50° C. and 250° C. because of its high latent heat or vaporization, a severe limitation exists in the potential threat of damage to a water loaded heat pipe, due to freezing of the water.

When a water heat pipe freezes, the expansion resulting as the water changes to ice can cause rupture of the heat pipe casing in much the same way as household plumbing is damaged by freezing. However, a second mode of failure can also be brought on by freezing. If the water is located within the rigid wick structure adjacent to the casing at the time of freezing, the expansion can cause distortion in the wick structure. This distortion moves the wick away from the casing wall and thereby prevents both evaporation and condensation from that portion of the wick. Such damage is irreversible and permanently degrades the performance of the heat pipe proportional to the amount of wick which is no longer in intimate contact with the casing.

The freezing problem is particularly serious if a heat pipe freezes when in a vertical or in an inclined position rather than in the horizontal position. In such situations a puddle of water which spans the entire diameter can form at the lower end of the heat pipe, and such a puddle, when frozen, exerts considerable force on the heat pipe wick and casing, frequently causing rupture of the casing or distortion of the wick.

The only approach to solving this problem to date has been the most obvious one, preventing freezing of the liquid. However, in commercial, as opposed to laboratory, operations such precautions are not always feasible, and the actual result has been a reluctance to use freezing prone liquids, such as water, in heat pipes.

SUMMARY OF THE INVENTION

The present invention overcomes the freezing problem by a new approach, by constructing the heat pipe in such a manner that no irreversible destruction occurs to the heat pipe, even if the liquid does actually freeze. This is essentially accomplished by building the heat pipe with two special features. The first is a wick constructed to have superior capillary lift and exceptionally high flexibility. The second feature is a quantity of fluid in the heat pipe limited to less than the amount which the high capillary lift wick will easily hold without overflow.

The combination of the special wick and the limited liquid inventory together assure that no puddle will form in the lower end of the heat pipe because all the liquid is contained within the wick. With no puddle spanning one dimension of the casing, even if the pipe is subjected to freezing temperatures, no forces are built up to cause rupture or distortion of the casing.

Moreover, if freezing should occur in the wick itself, forcing it away from the casing wall, the extreme flexibility of the wick prevents permanent distortion to the wick. When the frozen liquid thaws, the surface tension of the liquid alone is sufficient to move the highly flexible and undamaged wick back to its original position intimately pressing against the casing wall. A wick constructed of highly flexible woven fiberglass can easily survive repeated freezing and thawing within a water charged heat pipe providing the quantity of water is appropriately limited.

The basic construction technique while most valuable for the water based heat pipe is also applicable to any other fluid charge which may be solidified under some conditions of operation or storage.

BRIEF DESCRIPTION OF THE DRAWING

The drawing is a simplified cross-sectional view of a section of a heat pipe incorporating the invention, showing a liquid-vapor interface representative of that in water charged heat pipes.

DETAILED DESCRIPTION OF THE INVENTION

The essential aspects of the invention are shown in the FIGURE where heat pipe 10 is constructed with outer casing 12, highly flexible wick 14 and liquid 16.

The amount of liquid 16 put into heat pipe 10 before sealing casing 12 is critical for preventing damage to casing 12 if liquid 16 should freeze. The quantity of liquid must be equal to or less than that amount of liquid which, at the melting temperature, can be supported by vertical wick 14 and fully retained in wick 14 by the capillary forces of the wick.

As long as all the liquid within heat pipe 10 is retained in wick 14, none can form a puddle at the lowest point of casing 12. If a puddle which spans any dimension of casing 12 is permitted to freeze, the forces of expansion upon freezing may distort or rupture the casing and thus destroy the heat pipe. With all the liquid in the heat pipe stored within wick 14, however, none can form a puddle and, even if freezing conditions are encountered, no puddle exists to set up destructive forces.

The liquid within wick 14 can, however, still freeze, and such freezing will distort the wick and move it away from its proper location which is in intimate contact with the inside of casing 12. Such distortion typically causes protrusion of wick 14 into vapor space 18. With conventional wick construction such distortion would be permanent and, at the least, prevent proper heat transfer of the heat pipe in the area of the distorted wick. The present invention, however, provides for a particular selection of the wick material which prevents permanent distortion.

The wick material is made of exceptionally flexible material. The flexibility must be such that the surface tension of the heat pipe liquid will itself create enough force to overcome the mechanical strength of the wick, and pull it against the casing. A properly constructed wick will then be automatically properly repositioned, once the liquid within it thaws.

The success of the present invention has been demonstrated in practice by the use of a water-charged heat pipe. The heat pipe casing was constructed from copper tubing of 5/16 inch outside diameter and 1/32 inch wall. A wick of woven long staple fiberglass sleeving of ¼ inch outside diameter and 1/32 inch wall was fitted so that it rested against the inside diameter of the copper tubing.

The fiberglass sleeving was selected on the basis of experimental results which show that its mechanical strength in the direction transverse to its axis is surpassed by the surface tension of water. The fiberglass sleeving is, therefore, held against the inner wall of the copper tubing, and pulled back into position there by the force of surface tension of water if once displaced.

The demonstration heat pipe was also constructed with a specific, limited amount of water for heat transfer. This quantity was determined experimentally by determining the quantity of water supported by capillary forces in the fiberglass wick previously selected. The particular sleeving used supported water to a height of 16 inches when oriented vertically. A determination of the quantity of water supported can be made quite simply by determining the weight added to a dry wick by standing one end in the desired liquid. The weight thus determined is the maximum weight of liquid which can be added to the heat pipe and still preserve its non-puddling characteristic.

A heat pipe constructed with a fiberglass wick of at least 16 inch length and the quantity of water thus determined was constructed with a 48 inch casing length. The heat transfer capability was tested at 80 to 100 watts at approximately 100° C. when the heat pipe operated with 36 inch evaporator and 3 inch condenser lengths and its axis in a vertical orientation. A sample was also subjected to twenty four freeze-thaw cycles without change in dimension or deterioration of heat transfer characteristics.

It is to be understood that the form of the invention herein shown is merely a preferred embodiment. Various changes may be made in the size, shape and the arrangement of parts; equivalent means may be substituted for those illustrated and described; and certain features may be used independently from others without departing from the spirit and scope of the invention as defined in the following claims.

For example, the invention described may also be used in a gravity-free environment, such as in a space vehicle, where the location of potential puddles is determined by considerations other than gravity. In such a situation the flexible wick must be oriented to prevent a puddle from spanning any dimension of the heat pipe.

What is claimed as new and desired to be secured by Letters Patent of the United States is:

1. A heat pipe capable of operation without deterioration of its performance after repeated freezing and thawing cycles comprising:

a sealed outer casing;

a wick, positioned in intimate contact with the inside wall of the casing and located so as to reach any location of potential liquid puddling, said wick being sufficiently flexible so that, if distorted away from the casing wall, it will be repositioned against the wall of the casing by the surface tension of the liquid state of a fluid selected as the heat exchange fluid of the heat pipe; and a heat exchange fluid, loaded into the casing before sealing, limited in quantity to that amount which, at the melting point, will be completely retained within the wick by the capillary lifting force of the wick.

2. A heat pipe capable of operation without deterioration of its performance after repeated freezing and thawing as in claim 1 wherein the heat exchange fluid is water.

3. A heat pipe capable of operation without deterioration of its performance after repeated freezing and thawing as in claim 1 wherein the wick is woven fiberglass sleeving.

4. A heat pipe capable of operation without deterioration of its performance after repeated freezing and thawing as in claim 1 wherein the wick is woven long staple fiberglass sleeving.

* * * * *